US007424957B1

(12) United States Patent
Luberto

(10) Patent No.: US 7,424,957 B1
(45) Date of Patent: Sep. 16, 2008

(54) FRONT-LOADING DISPLAY AND DISPENSING APPARATUS

(75) Inventor: Michael D. Luberto, Rivervale, NJ (US)

(73) Assignee: Henschel-Steinau, Inc., Englewood, NJ (US)

( * ) Notice: Subject to any disclaimer, the term of this patent is extended or adjusted under 35 U.S.C. 154(b) by 68 days.

(21) Appl. No.: 11/439,677

(22) Filed: May 24, 2006

(51) Int. Cl.
*A47F 1/04* (2006.01)
*B65G 11/00* (2006.01)

(52) U.S. Cl. ..... 211/59.3; 312/61

(58) Field of Classification Search ..... 211/59.3, 211/59.2, 59.4, 184, 51; 312/61, 71, 35
See application file for complete search history.

(56) References Cited

U.S. PATENT DOCUMENTS 2,934,212 A * 4/1960 Jacobson ..... 211/59.3
3,035,587 A 5/1962 Schade
3,308,961 A * 3/1967 Chesley ..... 211/59.3
4,830,201 A 5/1989 Breslow
5,190,186 A 3/1993 Yablans et al.
5,469,976 A 11/1995 Burchell
5,833,076 A 11/1998 Harres et al.
6,041,720 A 3/2000 Hardy
6,142,317 A * 11/2000 Merl ..... 211/59.3
6,648,151 B2 11/2003 Battaglia et al.
7,063,217 B2 * 6/2006 Burke ..... 211/59.3
2005/0098515 A1 5/2005 Close

* cited by examiner

*Primary Examiner*—Katherine W Mitchell
*Assistant Examiner*—Candace L Bradford
(74) *Attorney, Agent, or Firm*—Arthur Jacob

(57) ABSTRACT

An improvement in an apparatus for displaying and dispensing merchandise in the form of packages arranged serially along a path of travel leading to a dispensing location at a point-of-purchase, the improvement utilizing a single spring member to establish a forward-directed biasing force urging the packages forward against a gate at the dispensing location, and to establish a rearward-directed biasing force on a pivotal connection for biasing the gate into the path of travel canted rearwardly at a steep acute angle to retain a forward-most package at the dispensing location. The gate can be pivoted selectively into a rearwardly canted position at a shallow acute angle to the path of travel for enabling restocking of serially arranged merchandise packages from the front of the apparatus by inserting packages through the dispensing location in a rearward direction.

11 Claims, 4 Drawing Sheets

FRONT-LOADING DISPLAY AND DISPENSING APPARATUS

The present invention relates generally to the point-of-purchase display and dispensing of merchandise and pertains, more specifically, to apparatus which enables the display and ready dispensing of serially arranged merchandise packages at a point-of-purchase dispensing location, while facilitating restocking by front loading through the dispensing location.

An ever-increasing variety of packaged merchandise offered for sale at points-of-purchase located along store shelves has led to a requirement for better organization of such merchandise, along with increased ease of selection and dispensing, together with simplified restocking. Display and dispensing trays have become staples in assisting the organizing, display and dispensing of such items.

The present invention provides an improvement in apparatus for displaying and dispensing merchandise at a point-of-purchase and for facilitating the reloading of such items at the point-of-purchase, as re-stocking becomes necessary. As such, the present invention attains several objects and advantages, some of which are summarized as follows: Provides an improvement which facilitates the display and dispensing of serially arranged merchandise packages at a point-of-purchase, together with ease of restocking; enables increased versatility in dispensing merchandise at a point-of-purchase while allowing simplified restocking at the point-of-purchase; facilitates the organization of merchandise for display and dispensing at points-of-purchase located along store shelves; provides simplified apparatus constructed economically of fewer component parts; allows ease of set-up and use for accommodating a wide variety of merchandise displayed and dispensed at a point-of-purchase; offers less obtrusive and aesthetically more desirable apparatus for the display and dispensing of merchandise packages; provides a less complex apparatus for the display and dispensing of merchandise at a point-of-purchase, capable of exemplary performance over a relatively long service life.

The above objects and advantages, as well as further objects and advantages, are attained by the present invention which may be described briefly as an improvement in an apparatus for displaying and dispensing merchandise at a point-of-purchase, the merchandise being in the form of packages arranged serially along a path of travel extending longitudinally toward a forward dispensing location placed at the point-of-purchase, the improvement comprising: a track extending longitudinally adjacent the path of travel for juxtaposition with the serially arranged packages; a pusher coupled with the track for movement in forward and rearward directions along the track adjacent the path of travel so as to engage the serially arranged packages for moving the packages forward toward the dispensing location; a biasing member coupled with the pusher for establishing a forward-directed biasing force exerted on the pusher to bias the pusher in the forward direction; a gate at the dispensing location; and a pivotal connection mounting the gate for movement relative to the track between a stop position, wherein the gate extends into the path of travel to intercept a forward-most package of the serially arranged packages to preclude forward movement of the forward-most package forward beyond the dispensing location, and a retracted position, wherein the gate is canted rearwardly to enable selective insertion of packages in a rearward direction through the dispensing location and along the path of travel to replenish serially arranged packages; the biasing member being coupled with the pivotal connection for establishing a rearward-directed biasing force pivotally biasing the gate into the stop position.

The invention will be understood more completely, while still further objects and advantages will become apparent, in the following detailed description of a preferred embodiment of the invention illustrated in the accompanying drawing, in which.

Figure 1:
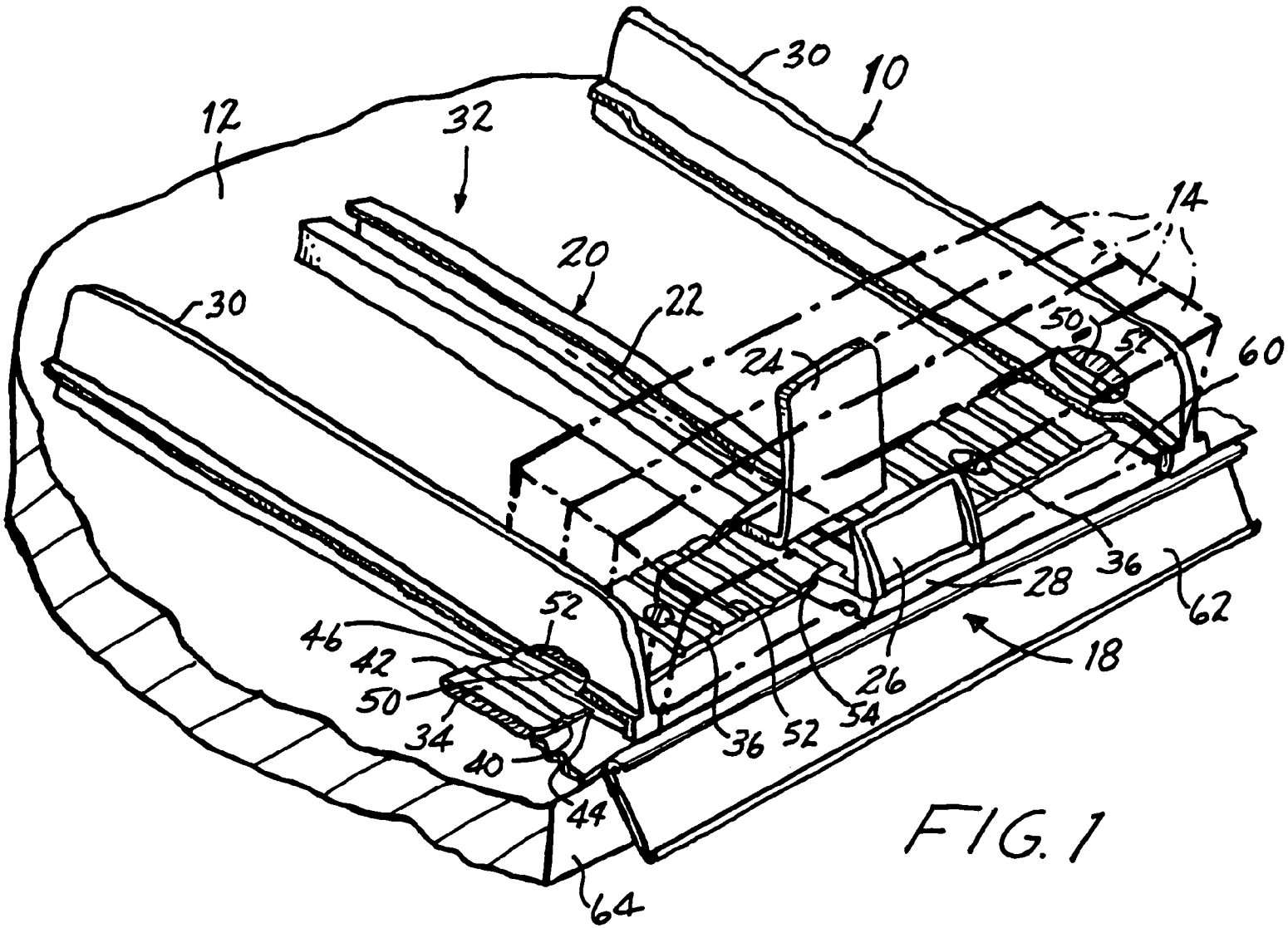
FIG. 1 is a pictorial perspective view of a shelf organizing apparatus utilizing an improvement constructed in accordance with the present invention.

Referring now to the drawing, and especially to FIG. 1 thereof, a shelf organizing apparatus 10 is shown installed upon a shelf 12 for presenting merchandise packages 14 for display and dispensing at a point-of-purchase 18. Apparatus 10 includes a pusher track assembly 20 upon which merchandise packages 14 are arranged serially along a path of travel 22 extending longitudinally between a pusher 24 and a gate 26 placed at a forward dispensing location 28 at the point-of-purchase 18. A pair of side dividers 30 establish a bay 32 between the dividers 30, within which bay 32 the merchandise packages 14 are confined for providing an organized display along the shelf 12, while assisting in maintaining alignment of the serial merchandise packages 14 along the path of travel 22.

A retainer plate 34 is affixed to shelf 12, as by threaded fasteners 36, and provides a forward lip 40 and a rearward lip 42 extending along the shelf 12 in lateral directions transverse to the longitudinal direction of path of travel 22. Corresponding forward and rearward fingers 44 and 46 are carried by the dividers 30 and are engaged with respective lips 40 and 42 to hold the dividers 30 juxtaposed with shelf 12. At the same time, a tongue 50 is integral with and depends from each of the dividers 30, between corresponding fingers 44 and 46, to engage a selected groove 52 of a plurality of grooves 52 spaced apart laterally along the retainer plate 34 to place each divider 30 at a selected location along the retainer plate 34.

In a similar manner, pusher track assembly 20 includes forward hooks 54 for engaging forward lip 40, rearward fingers 56 for engaging rearward lip 42, and a tongue 58 (see FIG. 4) for engaging a selected groove 52 along the retainer plate 34. With each tongue 50 and 58 placed within a corresponding selected groove 52, and with the fingers 44, 46 and 56, and hooks 54 engaged with corresponding lips 40 and 42, the dividers 30 and the pusher track assembly 20 are secured in place upon shelf 12 for an organized presentation of the serially arranged merchandise packages 14. A front plate 60 carries a channel 62 which extends along the front edge 64 of the shelf 12 for displaying identification information pertaining to the merchandise packages 14 offered at the point-of-purchase 18.

Figure 2:
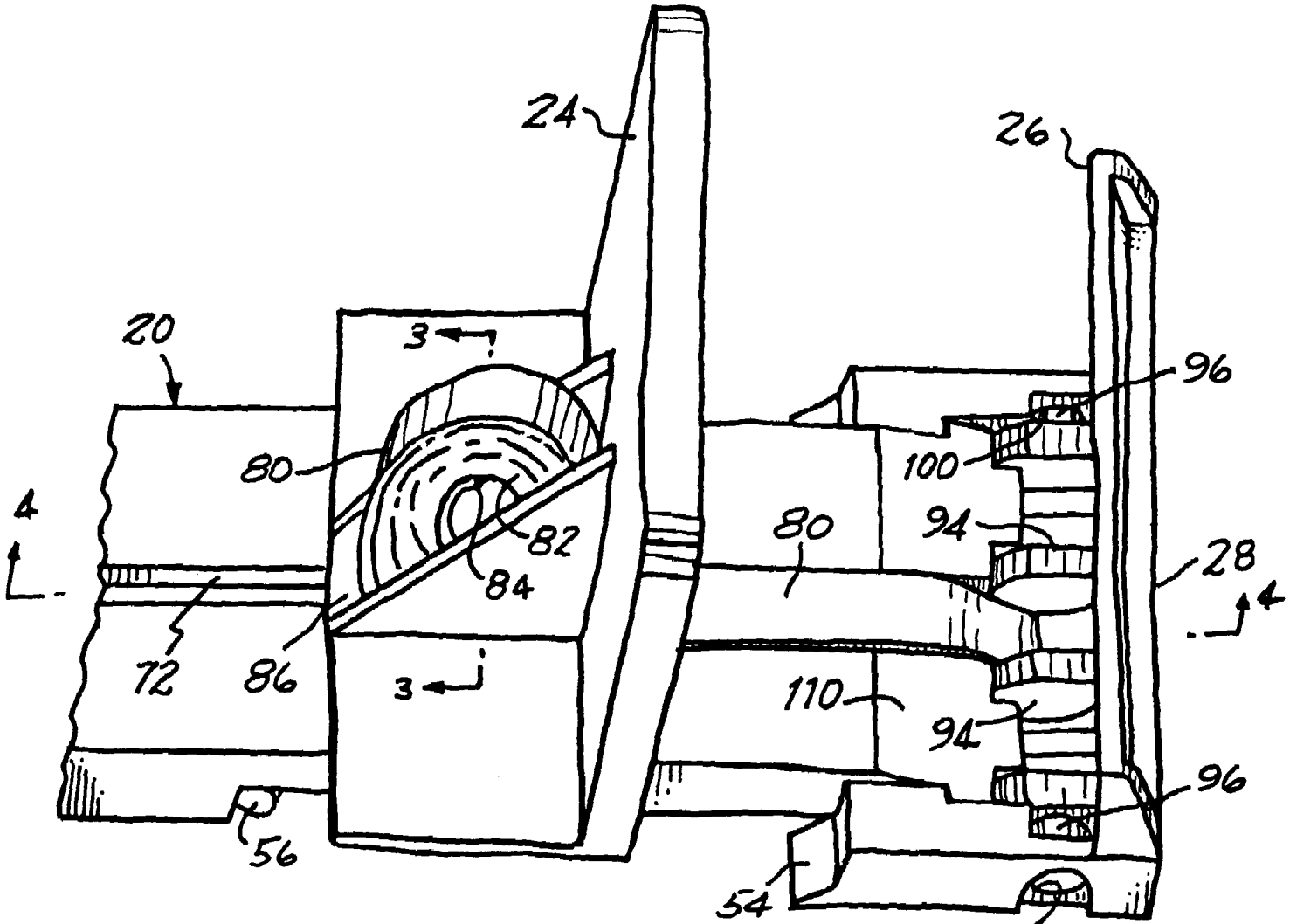
FIG. 2 is an enlarged fragmentary pictorial view of a portion of the apparatus.
Figures 3, 4:
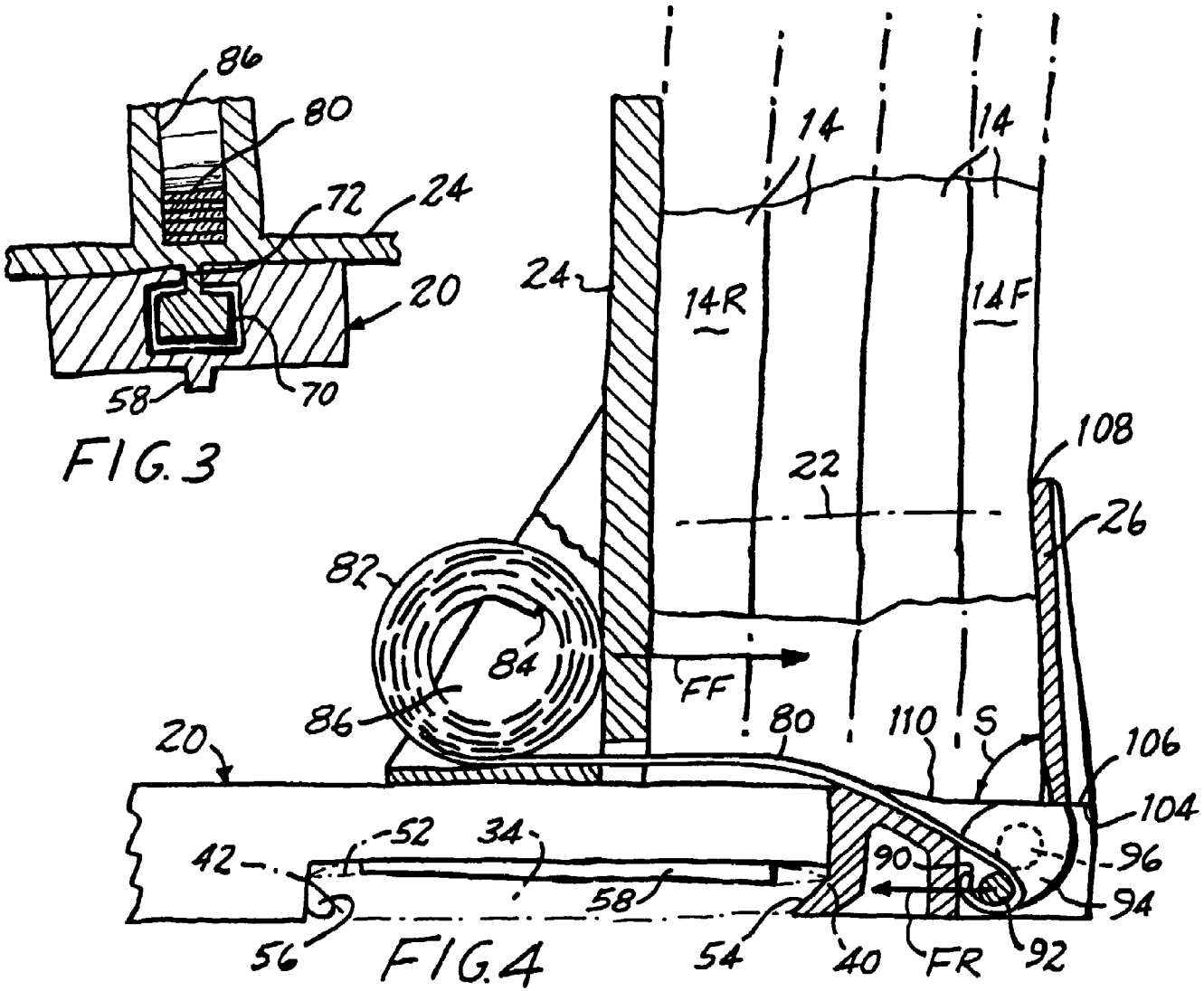
FIG. 3 is a fragmentary cross-sectional view taken along line 3-3 of FIG. 2.
FIG. 4 is a cross-sectional view taken along line 4-4 of FIG. 2.

Turning now to FIGS. 2 through 4, as well as to FIG. 1, pusher track assembly 20 includes a slide 70 engaged with a track 72 for sliding movement along track 72 in longitudinal directions parallel with path of travel 22. Slide 70 carries pusher 24 which is integral with slide 70 and projects upwardly from slide 70 into path of travel 22 so as to engage the rearward-most merchandise package 14R behind the package 14R. Gate 26 is placed at the dispensing location 28 and engages the forward-most merchandise package 14F. A biasing member in the form of a ribbon spring 80 is coiled to establish a coil 82 adjacent a first end 84 of the spring 80, and the coil 82 is placed in a compartment 86 located at the rear of the pusher 24 and is engaged with the pusher 24.

A second end 90 of the spring 80 is coupled to gate 26 by a coupling arrangement which includes attachment of the second end 90 at a location 92 to a crank 94 integral with the gate 26, the crank 94 enabling location 92 to be placed outside, and preferably below, the path of travel 22. Pivot pins 96 are integral with gate 26 and are journaled at 100 to complete a pivotal connection which mounts gate 26 for pivotal movement within pusher track assembly 20. In this manner, the single coiled spring 80 establishes a first biasing force FF in a forward direction, the first biasing force being transmitted to the pusher 24 at coil 82, biasing the pusher 24, and consequently the serially arranged merchandise packages 14, in a forward directions. At the same time, the single coiled spring 80 establishes a second biasing force FR in a rearward direction, which biasing force FR pulls upon crank 94 to bias the gate 26 into a stop position, illustrated in FIG. 4, wherein the gate 26 intercepts and engages the forward-most merchandise package 14F. The placement of location 92 below the path of travel 22, enabled by the coupling arrangement which couples the second end 90 of the spring 80 to gate 26 through crank 94, assures that the second end 90 of spring 80 is maintained outside the path of travel 22 so as not to impede placement of the forward-most merchandise package 14F fully against gate 26 and subsequent selective dispensing of the forward-most merchandise package 14F at the dispensing location 28. Further, by maintaining the second end 90 of spring 80 outside the path of travel 22, engagement of the second end 90 with the forward-most merchandise package 14F, and any consequent damage or marring of the forward-most package 14F, is avoided.

A stop shoulder 104 on the gate 26 engage a forward edge 106 on the pusher track assembly 20 so that upon being biased into the stop position, gate 26 is canted rearwardly at a relatively steep acute angle S with respect to the path of travel 22. The acute angle S assures that gate 26 will engage the forward-most merchandise package 14F at a location 108 placed far enough from track 72 to maintain stability in the serially arranged merchandise packages 14, while facilitating selective removal of the forward-most merchandise package 14F for dispensing the package 14F at the dispensing location 28. The preferred angle S is about 87°.

Figure 5:
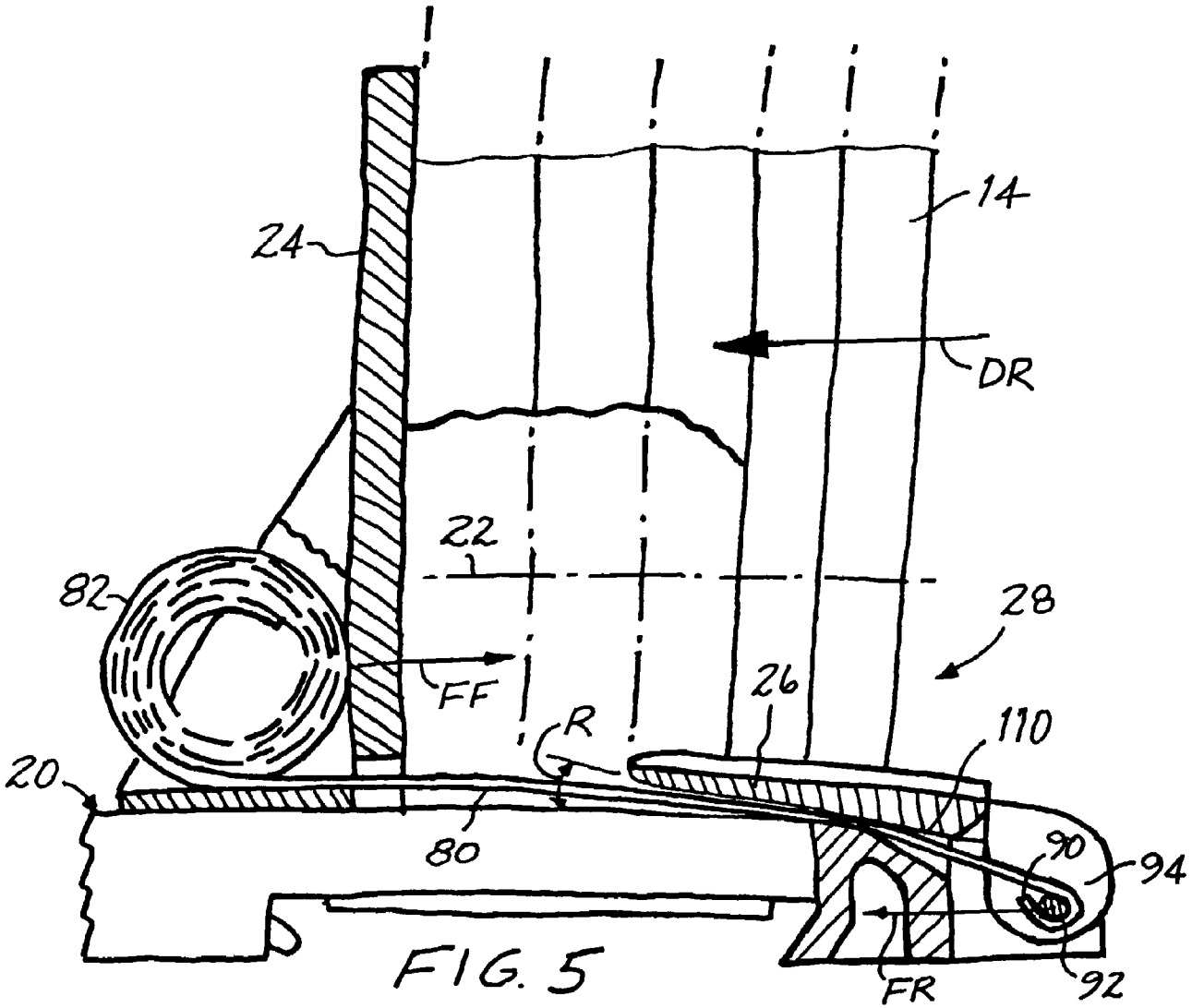
FIG. 5 is a cross-sectional view similar to FIG. 4, and showing component parts in another operating position.

When it becomes necessary or desirable to re-stock the merchandise packages 14, pusher track assembly 20 enables convenient reloading to be accomplished by inserting new merchandise packages 14 in a rearward direction DR through the dispensing location 28. As seen in FIG. 5, reloading is accomplished by pushing back upon gate 26 to pivotally move gate 26 against biasing force FR into a retracted position against a stop surface 110, wherein the gate 26 is canted rearwardly at a relatively shallow acute angle R with respect to the path of travel 22. The shallow angle R enables access to the pusher track assembly 20 from the front of the pusher track assembly 20 for establishing replenished serially arranged merchandise packages 14 in place against pusher 24. Further, the shallow angle R assures that upon release of gate 26 after restocking, the biasing force FF will be transmitted to gate 26, through the serially arranged merchandise packages 14, to assist the biasing force FR in returning gate 26 to the stop position, thereby preventing jamming of the gate 26 at the retracted position. The preferred shallow acute angle R is about 10°.

The utilization of the single spring 80 reduces the number of component parts and the complexity of pusher track assembly 20, while at the same time providing biasing forces FF and FR directed in opposite directions and in magnitudes which facilitate dispensing and reloading operations while militating against unwanted inadvertent dispensing of more than one merchandise package at a time, and against jamming during restocking.

It will be seen that the present invention attains the several objects and advantages summarized above, namely: Provides an improvement which facilitates the display and dispensing of serially arranged merchandise packages at a point-of-purchase, together with ease of restocking; enables increased versatility in dispensing merchandise at a point-of-purchase while allowing simplified restocking at the point-of-purchase; facilitates the organization of merchandise for display and dispensing at points-of-purchase located along store shelves; provides simplified apparatus constructed economically of fewer component parts; allows ease of set-up and use for accommodating a wide variety of merchandise displayed and dispensed at a point-of-purchase; offers less obtrusive and aesthetically more desirable apparatus for the display and dispensing of merchandise packages; provides a less complex apparatus for the display and dispensing of merchandise at a point-of-purchase, capable of exemplary performance over a relatively long service life.

It is to be understood that the above detailed description of a preferred embodiment of the invention is provided by way of example only. Various details of design and construction may be modified without departing from the true spirit and scope of the invention, as set forth in the appended claims.

The embodiments of the invention in which an exclusive property or privilege is claimed are defined as follows:

1. An improvement in an apparatus for displaying and dispensing merchandise at a point-of-purchase, the merchandise being comprised of packages arranged serially along a path of travel extending longitudinally toward a forward dispensing location placed at the point-of-purchase, the improvement comprising:

a track extending longitudinally adjacent the path of travel for juxtaposition with the serially arranged packages;

a pusher coupled with the track for movement in forward and rearward directions along the track adjacent the path of travel so as to engage the serially arranged packages for moving the packages forward toward the dispensing location;

a biasing member coupled with the pusher for establishing a forward-directed biasing force exerted on the pusher to bias the pusher in the forward direction;

a gate at the dispensing location;

a pivotal connection mounting the gate for movement relative to the track between a stop position, wherein the gate extends into the path of travel to intercept a forward-most package of the serially arranged packages to preclude forward movement of the forward-most package forward beyond the dispensing location, and a retracted position, wherein the gate is canted rearwardly to enable selective insertion of packages in a rearward direction through the dispensing location and along the path of travel to replenish serially arranged packages; and a coupling arrangement coupling the biasing member with the pivotal connection at a location outside the path of travel, the coupling arrangement enabling the biasing member to establish a rearward-directed biasing force essentially opposite to the aforesaid forward-directed biasing force exerted on the pusher for pivotally biasing the gate into the stop position.

2. The improvement of claim 1 wherein the biasing member comprises a spring member having opposite first and second ends, the first end being placed at the pusher for engaging the pusher to establish the forward-directed biasing force, and the second end being secured adjacent the pivotal connection to establish the rearward-directed biasing force essentially opposite to the aforesaid forward-directed biasing force exerted on the pusher.

3. The improvement of claim 2 wherein the coupling arrangement maintains the second end of the spring member below the path of travel of the serially arranged packages.

4. The improvement of claim 3 wherein the spring member comprises a ribbon spring coiled adjacent the first end to establish a coil carried by the pusher, and the pivotal connection includes a crank coupled to the second end of the spring member for movement in a rearward direction in response to the rearward-directed biasing force to bias the gate into the stop position.

5. The improvement of claim 1 wherein the gate, when in the stop position, is canted rearwardly at a steep acute angle to the path of travel.

6. The improvement of claim 5 wherein the steep acute angle is about 87°.

7. The improvement of claim 1 wherein the gate, when in the retracted position, is canted rearwardly at a shallow acute angle to the path of travel.

8. The improvement of claim 7 wherein the shallow acute angle is about 10°.

9. The improvement of claim 1 wherein the gate, when in the stop position, is canted rearwardly at a steep acute angle to the path of travel, and the gate, when in the retracted position, is canted rearwardly at a shallow acute angle to the path of travel.

10. The improvement of claim 9 wherein the steep acute angle is about 87° and the shallow acute angle is about 10°.

11. The improvement of claim 1 wherein the location outside the path of travel of the serially arranged packages is maintained below the path of travel.

* * * * *